US005808404A

United States Patent [19]

Koizumi et al.

[11] Patent Number: 5,808,404

[45] **Date of Patent: *Sep. 15, 1998**

[54] ELECTRON TUBE INCLUDING A CATHODE HAVING AN ELECTRON EMISSIVE MATERIAL LAYER

[75] Inventors: Sachio Koizumi; Toshifumi Komiya, both of Mobara, Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 709,735

[22] Filed: Sep. 9, 1996

[30] Foreign Application Priority Data

Sep. 18, 1995 [JP] Japan ..... 7-238723

[51] Int. Cl.[6] ..... H01J 1/20

[52] U.S. Cl. ..... 313/346 R; 313/346 DC; 313/337

[58] Field of Search ..... 313/346 R, 346 DC, 313/337, 270, 441, 411, 447

[56] References Cited

U.S. PATENT DOCUMENTS

| | | | |
|---|---|---|---|
| 4,291,252 | 9/1981 | Aida et al. | 313/346 R |
| 4,404,492 | 9/1983 | Palty | 313/346 R X |
| 4,737,679 | 4/1988 | Yamamoto et al. | 313/346 R |
| 4,823,044 | 4/1989 | Falce | 313/346 R X |
| 4,855,637 | 8/1989 | Watanabe et al. | 313/346 R |
| 5,118,984 | 6/1992 | Saito et al. | 313/346 R |
| 5,216,320 | 6/1993 | Koizumi et al. | 313/346 R |

*Primary Examiner*—Ashok Patel

*Attorney, Agent, or Firm*—Antonelli, Terry, Stout & Kraus, LLP

[57] ABSTRACT

A cathode for an electron tube has an electron emissive material layer on the surface of a cathode base metal. The electron emissive material layer has a three-layer structure composed of a first layer made of an alkaline earth metal oxide which is formed on the surface of the cathode base metal, a second layer which is an alkaline earth metal oxide layer in which a rare earth metal oxide is dispersed, which is formed on the surface of the first layer, and a third layer made of an alkaline earth metal oxide which is formed on the surface of the second layer.

15 Claims, 2 Drawing Sheets

ELECTRON TUBE INCLUDING A CATHODE HAVING AN ELECTRON EMISSIVE MATERIAL LAYER

BACKGROUND OF THE INVENTION

The present invention relates to an electron tube including a cathode having an electron emissive material layer, and particularly to an electron tube including a cathode having an electron emissive material layer of a three-layer structure having a first layer made of an alkaline earth metal oxide, a second layer made of an alkaline earth metal oxide containing a rare earth metal, and a third layer made of an alkaline earth metal oxide.

In general, there is a demand for high-definition images on a display screen of image display electron tubes such as a color picture tube or a data display tube along with diversification of information and high information content. To meet the demand, a cathode used for an image display electron tube must maintain stable electron emission characteristics over a long period of time at a high current density.

An electron tube including a cathode meeting such a demand is typically disclosed in Japanese Patent Laid-open No. Hei 5-12983.

FIG. 3 is a sectional view showing a configuration of the cathode disclosed in Japanese Patent Laid-open No. Hei 5-12983.

In FIG. 3, reference numeral 31 designates a cylindrical cathode sleeve; 32 is a cap-shaped cathode base metal; 33 is an alkaline earth metal oxide layer containing a rare earth metal (electron emissive material layer); 34 is a heater; 35 is a first layer made of an alkaline earth metal oxide; and 36 is a second layer which is an alkaline earth metal oxide layer in which a rare earth metal oxide is dispersed, for example, a composite oxide such as barium scandate ($Ba_2Sc_2O_5$).

Each of the cylindrical cathode sleeve 31 and the cap-shaped cathode base metal 32 closing one end of the cathode sleeve 31 is made of a material containing as a main component a high melting point metal such as nickel (Ni) incorporated with a low concentration of a reducing metal such as silicon (Si) or magnesium (Mg). The cylindrical cathode sleeve 31 houses the heater 34. These cylindrical cathode sleeve 31, cap-shaped base metal 32 and the heater 34 make up an indirectly heated cathode. The cathode base metal 32 has a two-layer-structure electron emissive material layer 33 deposited on its top surface. More specifically, the electron emissive material layer 33 is composed of a first layer 35 made of an alkaline earth metal oxide which is deposited on the cathode base metal 32 in contact with its top surface, and a second layer 36 which is an alkaline earth metal oxide layer in which a rare earth metal oxide such as barium scandate ($Ba_2Sc_2O_5$) is dispersed which is deposited on the surface of the first layer 35.

The electron emissive material layer 33 having the above configuration is fabricated by a method of depositing a first layer made of an alkaline earth metal carbonate on the top surface of the cathode base metal 32, depositing a second layer which is an alkaline earth metal carbonate layer in which a rare earth metal oxide such as barium scandate ($Ba_2Sc_2O_5$) is dispersed on the first layer, and converting the alkaline earth metal carbonates of the first and second layers into alkaline earth metal oxides respectively by thermal decomposition by heat treatment in electron tube processing, thus forming the above-described first layer 35 and the second layer 36.

In the electron emissive material layer 33 having the above configuration, the second layer 36 which is an alkaline earth metal oxide layer in which a rare earth metal oxide such as barium scandate ($Ba_2Sc_2O_5$) is dispersed, formed on the electron emissive material layer 33 on the electron-exit side, confines free barium (Ba) produced by a reducing element contained in the cathode base metal 32, within the second layer 36, and thereby maintains a high concentration of free barium in the electron emissive material layer 33. As a result, even when the cathode is operated at a high current density, barium (Ba) in the electron emissive material layer 33 forms a donor level and reduces an electric resistance, thus reducing joule heating and also the degree of evaporation of barium (Ba).

The cathode disclosed in Japanese Patent Laid-open No. Hei 5-12983 suffers little reduction in the amount of current emission even after having been operated at a high current density, for example, at a large current density in excess of $2A/cm^2$, and achieves a very long emission life.

The above-described prior art cathode is satisfactory to obtain electron emission characteristics stable over a long period of time; however, it fails to examine a reduction in amount of electrons obtainable from the electron emissive material layer 33.

In general, a rare earth metal oxide such as barium scandate ($Ba_2Sc_2O_5$) confines free barium (Ba) and maintains a high concentration of free barium (Ba) in the electron emissive material layer 33; it does not contribute to electron emission at all. Accordingly, when the content of a rare earth metal oxide such as barium scandate ($Ba_2Sc_2O_5$) in the electron emissive material layer 33 is increased for improving the high current density operating characteristics, the amount of electrons obtainable from the electron emissive material layer 33 is reduced.

In this way, the cathode disclosed in Japanese Patent Laid-open No. Hei 5-12983 has a disadvantage that when the content of the rare earth metal oxide such as barium scandate ($Ba_2Sc_2O_5$) is increased for improving the high current density operating characteristics, the amount of electrons obtainable from the electron emissive material layer 33 is reduced.

With respect to such a disadvantage, experiments showed that the amount of electrons obtainable from the electron emissive material layer 33 is clearly reduced as the content of a rare earth metal oxide such as barium scandate ($Ba_2Sc_2O_5$) is increased.

SUMMARY OF THE INVENTION

An object of the present invention is to provide an electron tube including a cathode having an electron emissive material layer capable of preventing a reduction in electron emission amount while maintaining superior high current density operating characteristics over a long period of time.

To achieve the above object, according to an aspect of the present invention, there is provided an electron tube including a cathode having an electron emissive material layer formed on the surface of a cathode base metal, wherein the electron emissive material layer has a three-layer structure composed of a first layer made of an alkaline earth metal oxide formed on the surface of the cathode base metal, a second layer which is an alkaline earth metal oxide layer in which a rare earth metal oxide is dispersed, formed on the surface of the first layer, and a third layer made of an alkaline earth metal oxide formed on the surface of the second layer.

With this configuration, the second layer confines free barium (Ba) therein to maintain a high concentration of free barium (Ba) in the whole electron emissive material layer and further the third layer contributes to normal electron emission, so that the amount of electrons obtainable from the electron emissive material layer is substantially equal to that of the prior art oxide cathode. As a result, the cathode of the present invention can achieve superior high current density and large current operating characteristics.

BRIEF DESCRIPTION OF THE DRAWINGS

The drawings form an integral part of the specification and are to be read in conjunction therewith, in which like reference numerals designate similar components throughout the figures, and in which.

DETAILED DESCRIPTION OF THE PREFERRED EMBODIMENT

Hereinafter, an embodiment of the present invention will be described with reference to the drawings.

Figure 1:
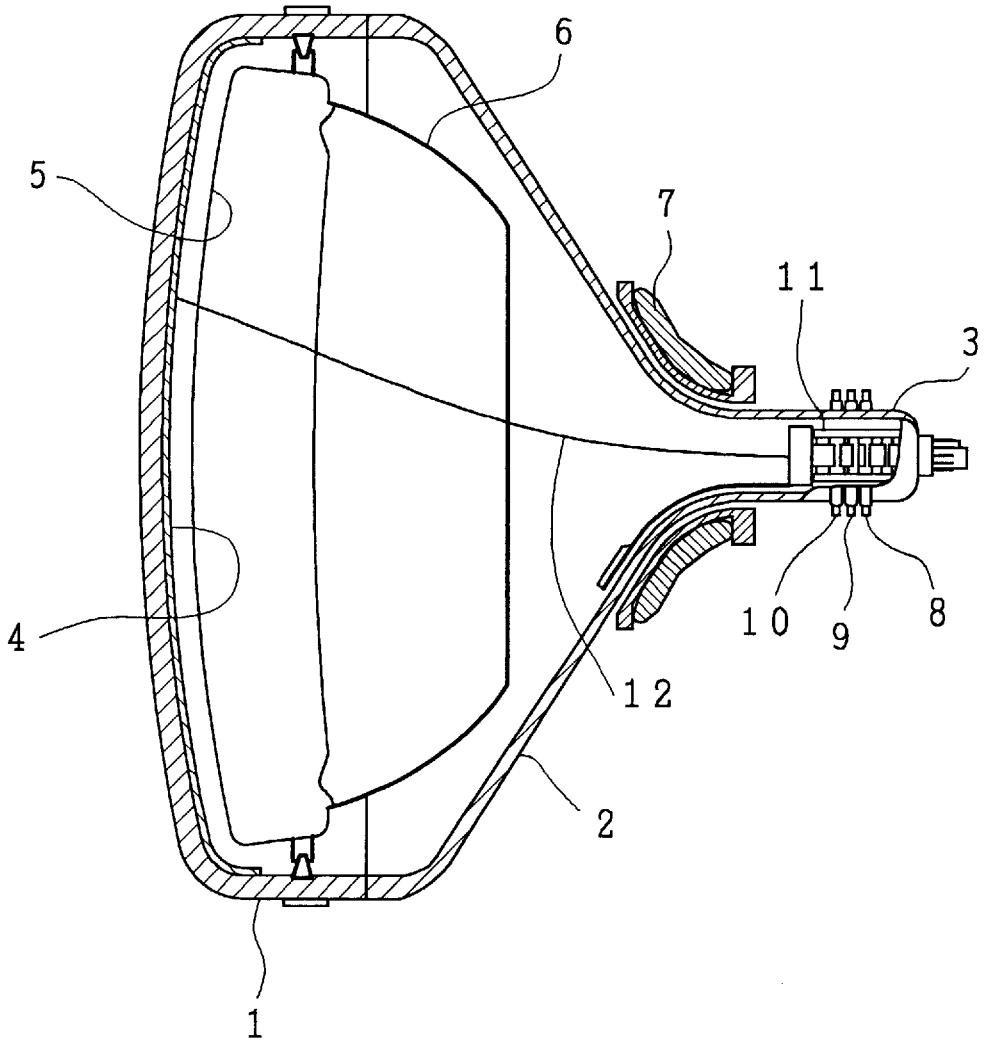
FIG. 1 is a sectional view showing a schematic configuration of one embodiment of an electron tube including a cathode having an electron emissive material layer according to the present invention.

FIG. 1 is a sectional view showing a schematic configuration of one embodiment of an electron tube including a cathode having an electron emissive material layer according to the present invention. In this embodiment, a color picture tube is used as the electron tube.

In FIG. 1, reference numeral 1 designates a panel portion; 2 is a funnel portion; 3 is a neck portion; 4 is a phosphor screen; 5 is a shadow mask; 6 is a magnetic shield; 7 is a deflection yoke; 8 is purity adjustment magnets; 9 is four-pole static convergence adjustment magnets; 10 is six-pole static convergence adjustment magnets; 11 is an electron gun; and 12 is an electron beam.

A tube envelope making up a color picture tube includes the panel portion 1 provided on the front side, the narrow neck portion 3 housing the electron gun 11, and the funnel portion 2 joining the panel portion 1 to the neck portion 3. The panel portion 1 has the phosphor screen 4 formed on its inner surface, and also has the shadow mask 5 fixedly disposed opposite the phosphor screen 4. The magnetic shield 6 is disposed inside the panel portion 1 and the funnel portion 2 in the neighborhood of their junction, and the deflection yoke 7 is disposed around the neck portion 3 and the funnel portion 2 in the neighborhood of their junction. The purity adjustment magnets 8, four-pole static convergence adjustment magnets 9 and six-pole static convergence adjustment magnets 10 are juxtaposed around the neck portion 3. Three electron beams (only one is shown in the figure) emitted from the electron gun 11 are deflected in a specified direction by magnetic fields of the deflection yoke 7, passing through one of a large number of electron beam apertures (not shown) provided in the shadow mask 5, and land on a picture element of a corresponding color in the phosphor screen 4, respectively.

The operation, that is, the image displaying operation in the color picture tube having the above configuration is the same as that in a known color picture tube, and therefore, the explanation thereof is omitted.

Figure 2:
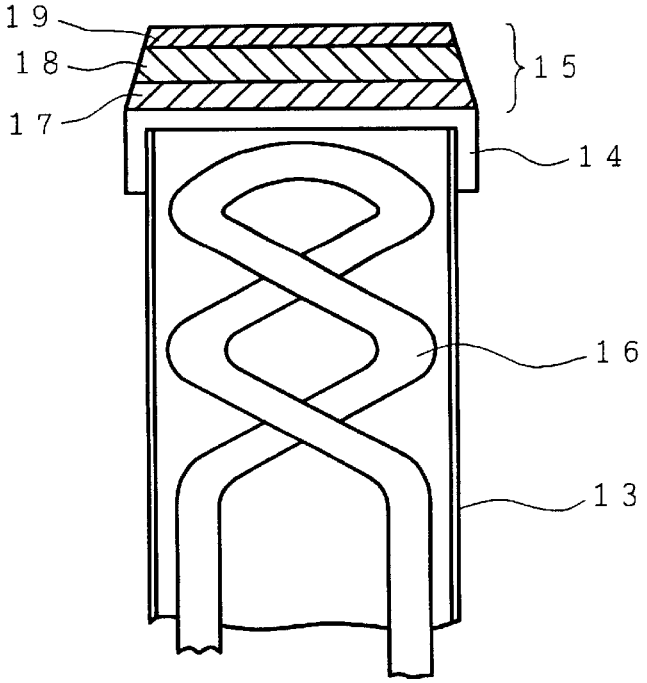
FIG. 2 is a sectional view showing one example of a configuration of a cathode having an electron emissive material layer used for an electron gun of the electron tube shown in FIG. 1.
Figure 3:
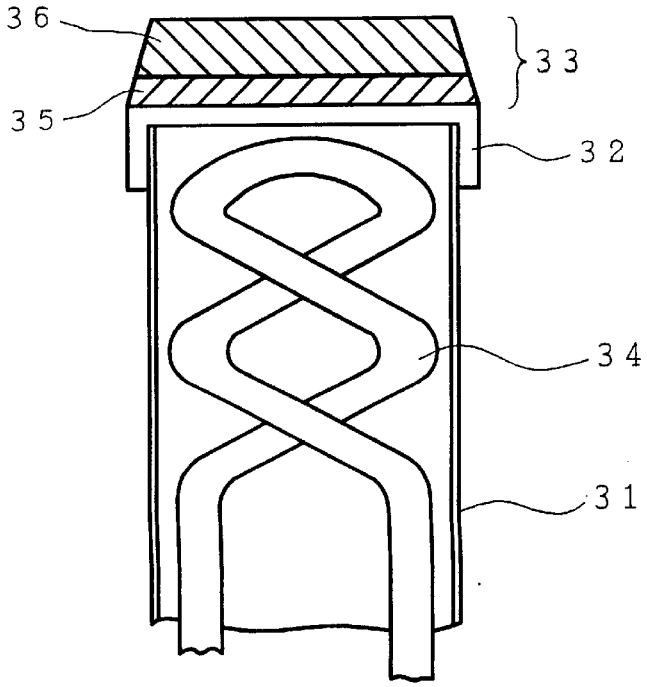
FIG. 3 (PRIOR ART)
FIG. 3 is a sectional view showing one example of a configuration of a cathode having an electron emissive material layer used for an electron gun of a prior art electron tube.

FIG. 2 is a sectional view showing one example of a configuration of a cathode having an electron emissive material layer used for the electron gun 11 of the color picture tube shown in FIG. 1.

In FIG. 2, reference numeral 13 designates a cylindrical cathode sleeve; 14 is a cap-shaped cathode base metal; 15 is an electron emissive material layer; 16 is a heater; 17 is a first layer made of an alkaline earth metal oxide; 18 is a second layer which is an alkaline earth metal oxide layer in which a rare earth metal oxide is dispersed, for example, a composite oxide of a rare earth metal such as barium scandate ($Ba_2Sc_2O5$); and 19 is a third layer made of an alkaline earth metal oxide.

Each of the cylindrical cathode sleeve 13 and the cap-shaped cathode base metal 14 is made of material containing as a main component a high melting point metal such as nickel (Ni) incorporated with a low concentration of a reducing metal such as silicon (Si) or magnesium (Mg). The cap-shaped cathode base metal 14 is fitted on the cylindrical cathode sleeve 13 so as to close one end thereof, and the cylindrical cathode sleeve 13 houses the heater 16, to thus make up an indirectly heated cathode. The electron emissive material layer 15 is deposited on the top surface of the cap-shaped cathode base metal 14, and it has a three-layer structure composed of a first layer 17 made of an alkaline earth metal oxide is dispersed, a second layer 18 which is an alkaline earth metal oxide layer in which a rare earth metal oxide such as barium scandate ($Ba_2Sc_2O_5$) is dispersed, and a third layer 19 made of an alkaline earth metal oxide. In this case, the first layer 17 is disposed on the cap-shaped cathode base metal 14 side of the electron emissive layer 15, the second layer 18 is formed on the first layer 17, and the third layer 19 is formed on the electron-exit side of the electron emissive layer 15.

In the electron emissive material layer 15 in this embodiment, each of the first layer 17 and the third layer 19 is made of an alkaline earth metal oxide converted from triple carbonates containing Ba, Sr, and Ca carbonates, ($(Ba,Sr,Ca)CO_3$) or the like, and the second layer 18 is an alkaline earth metal oxide layer in which a rare earth metal oxide converted from triple carbonates containing Ba, Sr, and Ca carbonates, ($(Ba,Sr,Ca)CO_3$) or the like containing barium scandate ($Ba_2Sc_2O_5$) or the like is dispersed.

Here, there will be described one example of a procedure of forming each of the first layer 17 and the third layer 19 made of an alkaline earth metal oxide, and the second layer 18 which is an alkaline earth metal oxide layer in which a rare earth metal oxide is dispersed.

A first suspension for forming each of the first layer 17 and the third layer 19, which is made of an alkaline earth metal oxide is dispersed, is prepared by adding sodium carbonate ($Na_2CO_3$) to a mixed solution containing a solute composed of 54 wt % of barium nitrate ($BaNO_3$), 39 wt % of strontium nitrate ($SrNO_3$) and 7 wt % of calcium nitrate $CaNO_3$), to precipitate triple carbonates containing Ba, Sr, and Ca carbonates, ($(Ba,Sr,Ca)CO_3$), and adding nitrocellulose lacquer and butyl nitrate to the precipitations (powders) and mixing them by rolling.

A second suspension for forming the second layer 18 which is an alkaline earth metal oxide layer in which a rare earth metal oxide is dispersed, is prepared by adding sodium carbonate ($Na_2CO_3$) to a mixed solution containing a solute composed of 53 wt % of barium nitrate ($BaNO_3$), 38 wt % of strontium nitrate ($SrNO_3$) and 6 wt % of calcium nitrate ($CaNO_3$), to precipitate triple carbonates containing Ba, Sr, and Ca carbonates, ($(Ba,Sr,Ca)CO_3$), mixing 3 wt % of barium scandate ($Ba_2Sc_2O_5$) with the precipitations (powders), and adding nitrocellulose lacquer and butyl nitrate to the mixture and mixing them by rolling.

Next, the top surface of the cap-shaped cathode base metal 14 containing as a main component nickel (Ni) is coated with the first suspension by spraying, to form the first layer 17 of a thickness of about 10 μm; the surface of the first layer 17 is coated with the second suspension by spraying, to form the second layer 18 of a thickness of about 50 μm; and the surface of the second layer 18 is coated with the first suspension by spraying, to form the third layer 19 of a thickness of about 5 μm. The electron emissive material layer 15 of the three layer structure is thus formed.

The electron emissive material layer 15 is then heated by the heater 16 during the evacuation of the electron tube to decompose the carbonates of barium, strontium, and calcium, ($(Ba,Sr,Ca)CO_3$) in the electron emissive material layer 15 into oxides of barium, strontium, and calcium, ($(Ba,Sr,Ca)O$), so that each of the first layer 17 and third layer 19 made of the alkaline earth metal oxide, and the second layer 18 which is the alkaline earth metal oxide layer in which the rare earth metal oxide is dispersed, are formed. After that, the electron emissive material layer 15 is activated by heating in an atmosphere of from 900° to 1100° C. to thus form a desired cathode.

In the cathode having the electron emissive material layer 15 according to the above configuration, the second layer 18 which is an alkaline earth metal oxide layer in which a rare earth metal oxide such as barium scandate ($Ba_2Sc_2O_5$) is dispersed, maintains a high concentration of free barium (Ba) in the electron emissive material layer 15 by the free-barium-confining function of the rare earth metal oxide is dispersed, and further the third layer 18 which is an alkaline earth metal oxide does not contain any material not contributing to electron emission, that is, any material harming electron emission, such as a rare earth metal oxide, so that the amount of electrons obtainable from the electron emissive material layer 15 is substantially equal to that of the prior art oxide cathode. As a result, there can be obtained a cathode having the electron emissive material layer 15 achieving superior high-density and large-current operating characteristics.

While a composite oxide of barium (Ba) and scandium (Sc), that is, barium scandate ($Ba_2Sc_2O_5$) is used as a rare earth metal oxide contained in the alkaline earth metal oxide material layer 18 in this embodiment, the present invention is not limited thereto. For example, a composite oxide of barium (Ba) and yttrium (Y) or a composite oxide of barium (Ba) and cerium (Ce) may be similarly used as a rare earth metal oxide dispersed in the alkaline earth metal oxide material layer 18. The rare earth metal oxide is dispersed in the second layer preferably in a range of 0.01 to 15 wt %.

Furthermore, the content of a rare earth metal oxide contained in the second layer 18, for example, a composite oxide of barium (Ba) and scandium (Sc), that is, barium scandate ($Ba_2Sc_2O_5$) is 3 wt % in this embodiment; however, it may be in a range of from 0.01 to 15 wt %. More specifically, when the content of a rare earth metal oxide dispersed in the second layer 18, for example, a composite oxide of barium (Ba) and scandium (Sc),that is, barium scandate ($Ba_2Sc_2O_5$) is less than 0.01 wt %, the second layer 18 which is an alkaline earth metal oxide layer in which a rare earth metal oxide is dispersed, cannot achieve its function. On the other hand, when it is more than 15 wt %, the function due to the addition of the rare earth metal oxide is rather degraded. In the cathode of this embodiment, the content of a rare earth metal oxide dispersed in the second layer 18, for example, a composite oxide of barium (Ba) and scandium (Sc), that is, barium scandate ($Ba_2Sc_2O_5$) is preferably in a range of from 0.05 to 3 wt %.

The thickness of the first layer 17 may be in a range of from 5 to 25 μm, preferably 15 μm. When it is more than 25 μm, the effect of confining barium (Ba) is reduced. The thickness of the second layer 18 may be in a range of from 30 to 70 μm, preferably 45 μm. The thickness of the third layer 19 may be in a range of from 5 to 20 μm, preferably 10 μm. The total thickness of the first, second and third layers is preferably 70 μm for electron emission.

As described above, according to the present invention, an electron emissive material layer deposited on the top surface of a cathode metal base has a three-layer structure composed of a first layer made of an alkaline earth metal oxide which is formed on the surface of the cathode base metal, a second layer which is an alkaline earth metal oxide layer in which a rare earth metal oxide is dispersed, which is formed on the surface of the first layer, and a third layer made of an alkaline earth metal oxide which is formed on the surface of the second layer. In this electron emissive material layer, the second layer confines free barium (Ba) and maintains a high concentration of free barium (Ba) in the electron emissive material layer and further the third layer contributes to normal electron emission, so that the amount of electrons obtainable from the electron emissive material layer is substantially equal to that of the prior art oxide cathode. As a result, there can be obtained an electron tube achieving superior high current density and large current operating characteristics.

What is claimed is:

1. An electron tube including a cathode having an electron emissive material layer formed on a surface of a cathode base metal, said electron emissive material layer comprising:

a first layer made of an alkaline earth metal oxide containing at least barium (Ba) and formed on said surface of said cathode base metal;

a second layer which is an alkaline earth metal oxide layer in which a rare earth metal oxide is dispersed, the second layer being formed on a surface of said first layer; and a third layer made of an alkaline earth metal oxide and formed on a surface of said second layer, said third layer containing intentionally no added rare earth metal oxide.

2. An electron tube including a cathode having an electron emissive material layer according to claim 1, wherein said rare earth metal oxide dispersed in said second layer is a composite oxide of barium (Ba) and scandium (Sc).

3. An electron tube including a cathode having an electron emissive material layer according to claim 1, wherein said rare earth metal oxide dispersed in said second layer is one of a composite oxide of barium (Ba) and yttrium (Y) and a composite oxide of barium (Ba) and cerium (Ce).

4. An electron tube including a cathode having an electron emissive material layer according to claim 1, wherein said second layer contains said rare earth metal oxide in a range of 0.01 to 15 wt %.

5. An electron tube including a cathode having an electron emissive material layer according to claim 2, wherein said second layer contains said rare earth metal oxide in a range of 0.01 to 15 wt %.

6. An electron tube including a cathode having an electron emissive material layer according to claim 3, wherein said second layer contains said rare earth metal oxide in a range of 0.01 to 15 wt %.

7. An electron tube including a cathode having an electron emissive material layer according to claim 1, wherein a thickness of said first layer is in a range of from 5 to 25 $\mu$m, a thickness of said second layer is in a range of from 30 to 70 $\mu$m, and a thickness of said third layer is in a range of from 5 to 20 $\mu$m; and said second layer contains a composite oxide of barium (Ba) and scandium (Sc) in an amount of from 0.05 to 3 wt %.

8. An electron tube including a cathode having an electron emissive material layer formed on a surface of a cathode base metal, formed by a method comprising the steps of:

forming an alkaline earth metal oxide layer, containing at least barium, on said surface of said cathode base metal;

forming a second layer, which is an alkaline earth metal oxide layer having rare earth metal oxide dispersed therein, on said alkaline earth metal oxide layer; and forming an alkaline earth metal oxide layer having no rare earth metal oxide intentionally dispersed therein, on said second layer.

9. An electron tube including a cathode having an electron emissive material layer formed on a surface of a cathode base metal, formed by a method comprising the steps of:

applying a first suspension, from which a first layer containing an alkaline earth metal oxide can be formed, on said surface of said cathode base metal, to form a first suspension film;

applying a second suspension, from which a second layer, which is an alkaline earth metal oxide layer in which a rare earth metal oxide is dispersed, can be formed, on a surface of the first suspension film, to form a second suspension film on the first suspension film;

applying a third suspension, from which a third layer, which is an alkaline earth metal oxide layer with no rare earth metal oxide intentionally dispersed therein, can be formed, on a surface of the second suspension film; and heating so as to form the first, second and third layers.

10. An electron tube including a cathode having an electron emissive material layer formed on a surface of a cathode base metal, said electron emissive layer comprising:

a first layer made of an alkaline earth metal oxide containing at least barium (Ba) and formed on said surface of said cathode base metal;

a second layer which is an alkaline earth metal oxide layer in which a rare earth metal oxide is dispersed, the second layer being formed on a surface of said first layer; and a third layer consisting essentially of an alkaline earth metal oxide and formed on a surface of said second layer.

11. An electron beam tube including a cathode having an electron emissive material layer according to claim 10, wherein said third layer consists of said alkaline earth metal oxide.

12. An electron tube including a cathode having an electron emissive material layer formed on a surface of a cathode base metal, formed by a method comprising the steps of:

forming an alkaline earth metal oxide layer, containing at least barium, on said surface of said cathode base metal;

forming a second layer, which is an alkaline earth metal oxide layer having rare earth metal oxide dispersed therein, on said alkaline earth metal oxide layer; and forming a third layer consisting essentially of an alkaline earth metal oxide is dispersed, on said second layer.

13. An electron tube including a cathode having an electron emissive material layer according to claim 12, wherein said third layer consists of said alkaline earth metal oxide.

14. An electron tube including a cathode having an electron emissive material layer formed on a surface of a cathode base metal, formed by a method comprising the steps of:

applying a first suspension, from which a first layer containing an alkaline earth metal oxide can be formed, on said surface of said cathode base metal, to form a first suspension film;

applying a second suspension, from which a second layer, which is an alkaline earth metal oxide layer in which a rare earth metal oxide is dispersed, can be formed, on a surface of the first suspension film, to form a second suspension film on the first suspension film;

applying a third suspension, from which a third layer, which consists essentially of an alkaline earth metal oxide, can be formed, on a surface of the second suspension film; and heating so as to form the first, second and third layers.

15. An electron tube including a cathode having an electron emissive material layer according to claim 14, wherein said third suspension is a suspension from which a third layer, which consists of said alkaline earth metal oxide, can be formed.

* * * * *

UNITED STATES PATENT AND TRADEMARK OFFICE

CERTIFICATE OF CORRECTION

PATENT NO. : 5,808,404

DATED : September 15, 1998

INVENTOR(S) : KOIZUMI, et al.

It is certified that error appears in the above-identified patent and that said Letters Patent is hereby corrected as shown below:

In Claim 10, line 3, after "emissive" insert --material--.

In Claim 11, line 1, delete "beam".

Signed and Sealed this

Thirty-first Day of August, 1999

*Attest:*

Q. TODD DICKINSON

*Attesting Officer*

*Acting Commissioner of Patents and Trademarks*